United States Patent [19]

Kwan

[11] 4,209,132

[45] Jun. 24, 1980

[54] SHOWER SPRAY HEADS

[75] Inventor: Wong M. Kwan, North Point, Hong Kong

[73] Assignee: Well Men Industrial Company Limited, Quarry Bary, Hong Kong

[21] Appl. No.: 888,427

[22] Filed: Mar. 20, 1978

[30] Foreign Application Priority Data

Mar. 18, 1977 [GB] United Kingdom ..... 11595/77

[51] Int. Cl.[2] ..... B05B 1/08; B05B 3/16

[52] U.S. Cl. ..... 239/381; 239/102; 239/440

[58] Field of Search ..... 239/101, 102, 229, 240, 239/242, 389, 380–383, 437, 439–441, 444–449, 538, 541

[56] References Cited

U.S. PATENT DOCUMENTS

| | | | |
|---|---|---|---|
| 1,796,942 | 3/1931 | Pottenger | 239/242 X |
| 1,855,647 | 4/1932 | Pottenger | 239/101 X |
| 2,691,549 | 10/1954 | Hayward | 239/440 |
| 3,653,598 | 4/1972 | Waldrum | 239/229 |
| 3,762,648 | 10/1973 | Deines et al. | 239/383 |
| 3,874,595 | 4/1975 | Rindisbacher | 239/102 X |
| 4,010,899 | 3/1977 | Heitzman | 239/383 X |
| 4,079,891 | 3/1978 | Kwan | 239/383 X |

*Primary Examiner*—Johnny D. Cherry
*Attorney, Agent, or Firm*—Perry Carvellas

[57] ABSTRACT

A shower spray head for providing a fluid spray with mechanical vibration of a part of the spray head, comprises, in combination, a fluid flow for delivering a shower spray; a turbine mounted in the path and drivable in rotation about an axis by fluid flow through the path; an eccentric rotatable form mounted for rotation about the axis and drivable by the turbine and eccentrically mounted with respect to the axis; and a vibratory housing connected by a pivotal connection to the eccentric form whereby rotation of the turbine during use causes vibration of the vibratory housing.

7 Claims, 11 Drawing Figures

SHOWER SPRAY HEADS

FIELD OF INVENTION

This invention relates to spray nozzles or shower heads for producing a shower in for example a home showerbath, with mechanical vibration of the shower heads during use.

BACKGROUND OF THE INVENTION AND PRIOR ART

Spray nozzles for producing pulsating streams of water are known and used for example in domestic bathrooms for producing pleasant massage effects. For example, U.S. Pat. No. 3,762,648 and my copending U.S. patent application Ser. No. 761,325, now U.S. Pat. No. 4,079,891, describe such arrangements. A certain degree of pulsation is produced in internal parts of the construction of the said prior patent and application, and in the pulsating shower spray construction of U.S. Pat. No. 3,734,410. It is however desirable to produce stronger massage effects than are obtainable when a stream of water is modulated.

OBJECTS OF THE INVENTION

An object of this invention is a spray nozzle or shower head which incorporates a vibratory member which vibrates during use, so that the shower head can be used as a vibratory massager.

Another object is a spray nozzle or showerhead in which a vibratory member has a brush massager mounted thereon. A further object of the invention is a spray nozzle or shower head for producing a user-adjustable combination of a shower spray with mechanical vibration of a vibratory member, and alternative or additional pulsating spray and continuous (non-pulsating) spray. Further objects will be apparent from the disclosure.

SUMMARY OF THE INVENTION

The invention provides a shower spray head for providing a fluid spray with mechanical vibration of a part of said head, said shower spray head comprising, in combination, means forming a fluid flow path for delivering a shower spray; a turbine member mounted in said path and drivable in rotation about an axis by fluid flow through said path, an eccentric rotatable member mounted for rotation about said axis and which is drivable by said turbine member and eccentrically mounted with respect to said axis; and a vibratory member connected by a pivotal connexion to said eccentric member whereby rotation of said turbine member during use causes vibration of said vibratory member. In one suitable embodiment of the invention, the eccentric member is an eccentric cam of substantial diameter around which said vibratory member is pivotally located with play, so that rotation of said cam caused by rotation of said turbine causes vibration of said vibratory member. The cam can suitably be an elliptical formation integral with and disposed eccentrically about said axis, and said vibratory member can have a circular aperture located about said elliptical formation with play to form said pivotal connexion.

In an alternative embodiment, an arm is pivoted at one end thereof to a cam forming said vibratory member, said vibratory member being mounted for reciprocating motion about an axis which is spaced from said axis of rotation of said turbine.

The invention also provides a spray nozzle or shower head comprising a housing having a fluid inlet and a plurality of fluid discharge orifices, the housing having therein a turbine member mounted for rotation about an axis and drivable in rotation about said axis by fluid flowing through the head, the turbine member carrying an eccentric member which is mounted eccentrically of said axis, said eccentric member being connected pivotally to a vibratory member which is accessible to the exterior of the head, whereby fluid flow through the head causes vibration of said accessible vibratory member. Suitably a massage brush can be mounted on said vibratory member. In two practical embodiments of the shower head described below with reference to drawings, there are provided two alternative fluid flow paths, a first alternative flow path including pulsation means for cyclic interruption of the fluid flow along it, for providing a pulsating fluid spray, and a second alternative flow path for producing a non-pulsating spray, control means being provided and manually operable by a user to distribute the flow adjustably amongst the flow paths.

As described below, the pulsation means can very suitably be as described in my U.K. Patent Specification No. 1,490,836, which corresponds to my U.S. Patent Application Ser. No. 761,325, now U.S. Pat. No. 4,079,891.

In an embodiment of the invention particularly described below, the turbine, the vibratory member (which comprises a vibratory portion of the shower head housing), spray discharge outlets from a first flow path, and spray discharge outlets from a second alternative flow path, are disposed at respective radial distances about an axis, and the pulsation means and spray discharge outlets therefor are located centrally.

Two embodiments of the shower head or spray nozzle of the invention are hereinafter particularly described by way of example only with reference to the accompanying drawings, made a part hereof.

DETAILED DESCRIPTION OF THE DRAWINGS

Figure 1:
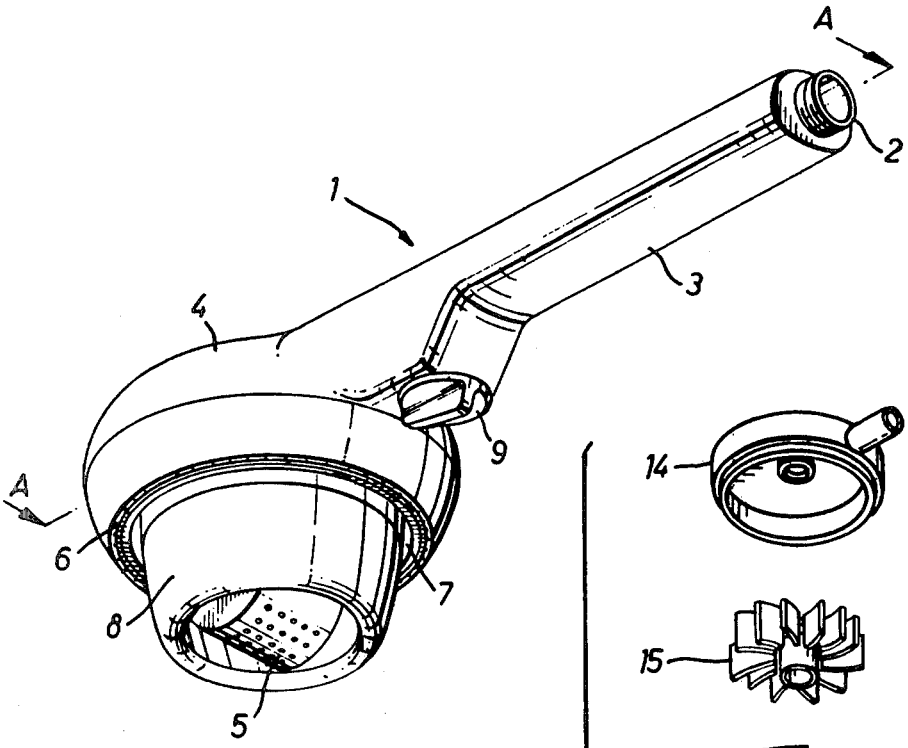
FIG. 1 is a diagrammatic perspective view of a shower head according to an embodiment of the invention.

FIG. 1 of the drawings shows a spray nozzle according to the invention, designated 1, in perspective view, in the form of a shower spray head adapted for attachment to the end of a flexible water-pipe or hose by an inlet connector 2 and adapted for hand-held use by means of a hollow handle portion 3 forming part of housing 4. The nozzle 1 has a central group of spray discharge outlets 5, from which a pulsating spray can be delivered as described below, a peripheral group of discharge outlets 6, for delivering a non-pulsating spray, and a peripheral outlet 7 for delivering a spray with simultaneous mechanical vibration of a vibratory housing portion 8 in a manner to be described below. A manually operable rotary function selector control 9 enables the flow to be adjustably distributed amongst the flow paths leading to the three types of outlets 6, 7 and 8.

Figure 3:
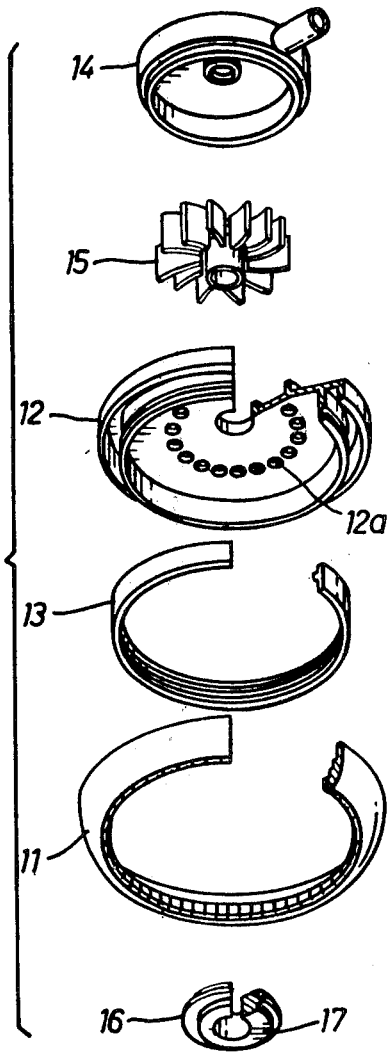
FIGS. 2 and 3 together constitute a diagrammatic exploded view of the head of FIG. 1.
Figure 2:
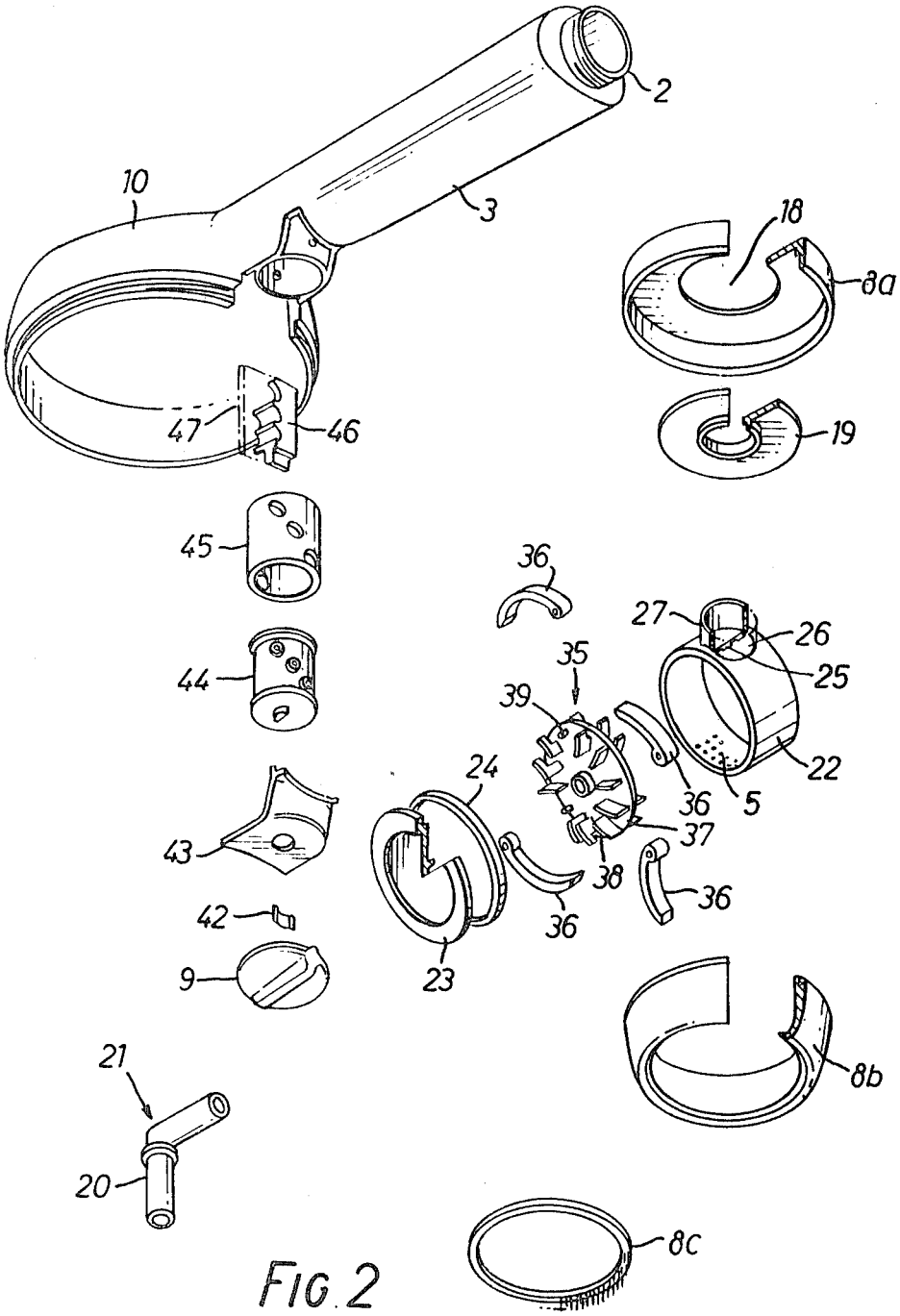
Figure 4:
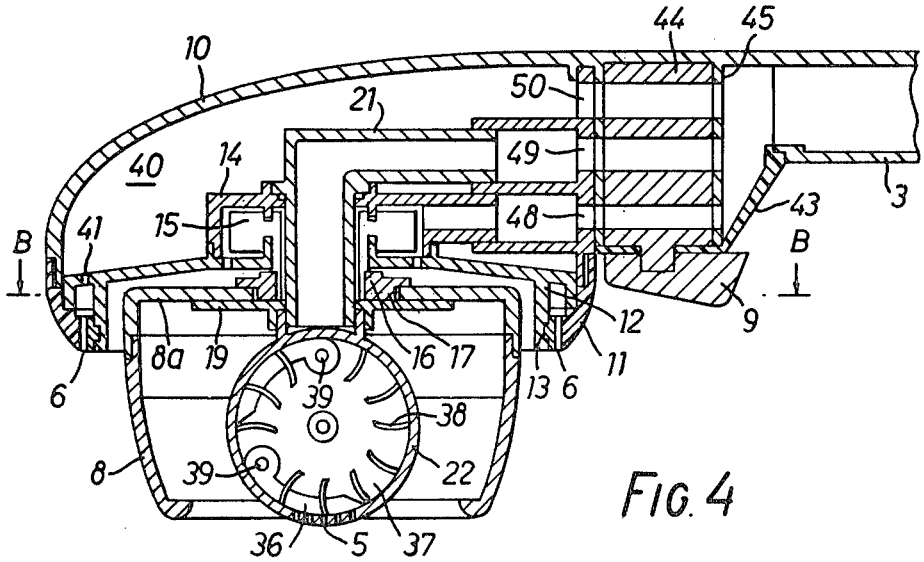
FIG. 4 shows a cross-section along the line A—A of FIG. 1.

FIGS. 2 and 3 together form an exploded and partly cut-away view of the nozzle of FIG. 1, and FIG. 4 is a corresponding sectional view.

The housing 4 shown in FIG. 1 comprises an upper hollow housing portion 10 integral with the handle 3 and inlet connector 2, engageable by a screw thread with a lower housing portion 11. The housing portions can suitably be of plastics material.

Located with the housing so formed are an apertured inner housing 12 and a ring 13, which cooperate with lower housing portion 11 to form outlets 6.

The upper surface of inner housing 12 is attached to and cooperates with a cover 14 to form a chamber within which is located a turbine member 15. Cover 14 has an inlet tube for conducting fluid flow from flow selector mechanism to be described below to the turbine chamber. The inlet to the chamber is arranged so that the entering flow impinges on the turbine blades in such a direction as to cause the turbine 15 to rotate.

Turbine member 15 has a central cylindrical bushing which extends downwards through a central aperture in inner housing 12 to mate with an apertured disc 16 bearing an eccentric member 17 in the form of an elliptical formation located eccentrically relative to the aperture to form an offset cam. Turbine member 15 and disc 16 with eccentric member 17 are so attached, e.g. by adhesive or splined connection, as to rotate as a unit.

Around eccentric member 17 is located (with play) a circular aperture 18 in an upper member 8*a* which, together with lower member 8*b* threadedly engaged thereto, forms the vibratory housing portion 8.

Vibratory housing portion 8 is located in position partly within housing 4, and retained in position with lateral free play between inner housing 12 and an apertured bushed plate 19 which in turn is attached to the axial portion 20 of an angled tube 21, which extends upwards through the central aperture in inner housing 12 and through the cylindrical bushing of turbine 15 and disc 16, to connect with flow selector mechanism to be described below.

A first flow path of the spray nozzle is formed by a path from the flow selector mechanism to be described below, via the inlet in cover 14 and the turbine chamber formed by inner housing 12 and cover 14, and apertures 12*a* in inner housing 12 leading to outlet 7 between lower housing portion 11 and vibratory housing portion 8.

Figure 5:
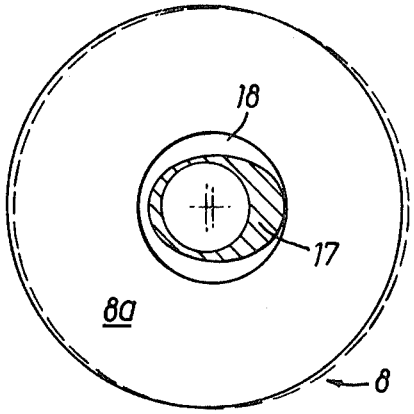
FIG. 5 is a fragmentary diagrammatic sectional plan looking in the direction B—B in FIG. 4.

Mechanical vibration is produced in operation by fluid flow along this flow path, as fluid entering the turbine chamber causes turbine 15 to rotate together with disc 16 carrying eccentric member 17. The rotation of eccentric member 17 causes vibration in the vibratory housing portion 8 owing to the location of eccentric member 17 within aperture 18 of upper member 8*a*, (shown more clearly in the fragmentary diagrammatic sectional plan FIG. 5). The fluid flow along this flow path emerges as spray from outlet 7. The bushing of turbine 15 is not a tight fit about angled tube 21 so that some fluid flow also finds its way between the bushing and the tube: this brings about a lubricating effect. A ring 8*c* bearing a brush (shown in FIGS. 2 & 3) can be attached to vibratory housing portion 8 and can be used as a vibratory massage device when the spray nozzle is being used in its vibratory mode.

A first alternative flow path of the spray nozzle is formed by a path from the flow selector mechanism to be describe below, via the angled tube 21, which connects via the apertured bushed plate 19 with pulsation means comprising a rotary valve and valve chamber for supplying a pulsating spray to the outlets 5.

The valve chamber is made up of a cylindrical valve chamber body 22 having one end closed by an integral wall and the other end closed by a screw-threaded cover 23, sealing being provided by a rubber sealing ring 24. Opening out of the cylindrical surface of the valve chamber body 22 are outlets which open externally to form outlets 5. Opening into the cylindrical surface of the valve chamber body 22 on the opposite side thereof from outlets 5 is an inlet 25, formed by a pair of slots in the wall of the body 22 partly occluded by a semicircular insert 26, so that the inlet passes through the wall thickness at an oblique angle and so that water passing through inlet 25 has a component of motion tangential to the cylindrical valve chamber body 22. Integral with valve chamber body 22 is a cylindrical neck 27 (shown partly cut away in FIG. 2) disposed about inlet 25, and connected with the fluid supply via the apertured bushed plate 19 and angled tube 21.

Mounted for rotation within the rotary valve chamber body 22 is a rotary valve generally designated 35. Rotary valve 35 has four arcuate flaps pivotally mounted thereon, of which two are designated 36 (FIG. 2). Each arcuate flap 36 has an arcuate part-cylindrical surface which is substantially complementary with the inner cylindrical surface of the cylindrical valve chamber body 22.

Rotary valve 35 comprises a disc or plate 37, which has bushings centrally disposed on each side, and which fits with clearance in the cylindrical valve chamber. Plate 37 is mounted for rotation within said chamber about the axis of the chamber and also about the centre and in the plane of said plate 37, by means of bushings disposed centrally on the inner side of cover 23, and on the inside of the opposite circular end face of cylindrical valve chamber body 22, which bushings telescopically overlap said bushings of said plate 37. Plate 37 has on each surface thereof a plurality of turbine blades 38, and pins 39 adjacent the periphery of plate 37 for pivotally and releasably mounting the arcuate flaps 36. Some of the turbine blades 38 are cut away so that they can accommodate the arcuate flaps within the periphery of plate 37 and retain the flaps axially on their mounting pins 39. Pins 39, about which said arcuate flaps 36 are pivotable, are parallel and equidistant to the axis of rotation of the rotary valve 35, and arranged in two pairs, with one pin of each pair on each surface of plate 37, and on opposite radii thereof. The two pins 39 on each surface of plate 37 are so disposed and the arcuate flaps mounted thereon are of such a length that said flaps occupy adjacent arcs of the periphery of plate 37.

Rotary valve 35 is mounted in the valve chamber in such a direction that water entering the chamber through inlet 25 thereof drives valve 35 in rotation by impinging on the turbine blades 38, and so that arcuate flaps 36 trail the valve member, and trail behind their pivot mountings, being urged centrifugally against the cylindrical periphery of the chamber. The outlets in the cylindrical inner surface of the valve chamber body 22, in communication with respective outlets 5 on the outside surface thereof, are arranged in two groups, each of which groups is disposed on said cylindrical surface so that it is swept by the arcuate flaps 36 on one of said surfaces of plate 37 when the valve 35 is driven in rotation. Hence in operation the arcuate flaps cyclically occlude outlets 5 during rotation of the turbine when the control switch is set to allow flow through the valve chamber, to give a pulsating spray through outlets 5.

The operation of this form of pulsation means is described in my copending U.K. patent application No. 17853/76 dated Apr. 30, 1976 which corresponds to U.S. Pat. No. 4,079,891.

A second alternative flow path of the spray nozzle is formed by space 40 within upper housing 10 and externally of the turbine chamber formed by inner housing 12 and cover 14, and externally of angled tube 21. This space 40 conducts fluid flow from flow selector mechanism to be described below to the outlets 6, via a set of apertures 41 peripherally spaced about inner housing 12 (shown in FIG. 4 but not FIGS. 2 and 3). This second alternative flow path provides a non-pulsating spray, without driving turbine 15 to cause vibration of the vibratory housing portion 8.

The flow selector mechanism of the spray nozzle is located between the hollow handle portion 3 and the upper housing portion 10 of the housing 4.

The manually-operable rotary function selector control 9 is attached by means of a leaf spring 42 and through a housing cover portion 43 to an apertured selector cylinder 44 around which is fitted correspondingly apertured rubber gasket 45. The selector cylinder 44 is rotatable by control 9 to wipe an inlet surface 46 of a flow connecting piece 47 (shown partly broken away in FIGS. 2 and 3). Flow connecting piece 47 has three apertures in the portion of its surface wiped by cylinder 44: a first aperture 48 thereof opens into a connector tube attached to the inlet tube of cover 14: a second aperture 49 opens into a connector tube attached to angled tube 21: and a third aperture 50 opens into space 40 within upper housing portion 10. Hence it can be seen that fluid flow through aperture 48 provides spray through outlet 7 with vibration of the vibratory housing portion 8, and fluid flow through aperture 49 provides the pulsating spray through outlets 5, and fluid flow through aperture 50 provides the non-pulsating spray through outlets 6.

It can also be seen that flow into each of apertures 48, 49 and 50 can occur only when an apertured portion of cylinder 44 and gasket 45 is aligned therewith, and is blocked when a portion of the cylinder wall is aligned therewith. The distribution of apertures in selector cylinder 44 is chosen to allow manual selection of fluid flow through apertures 48, 49, and 50, singly or in combination according to the location of apertures in cylinder 44 and the setting of control 9, and hence to provide spray through outlets 5, 6 and/or 7 and pulsation and/or vibration as desired by the user.

Figure 6:
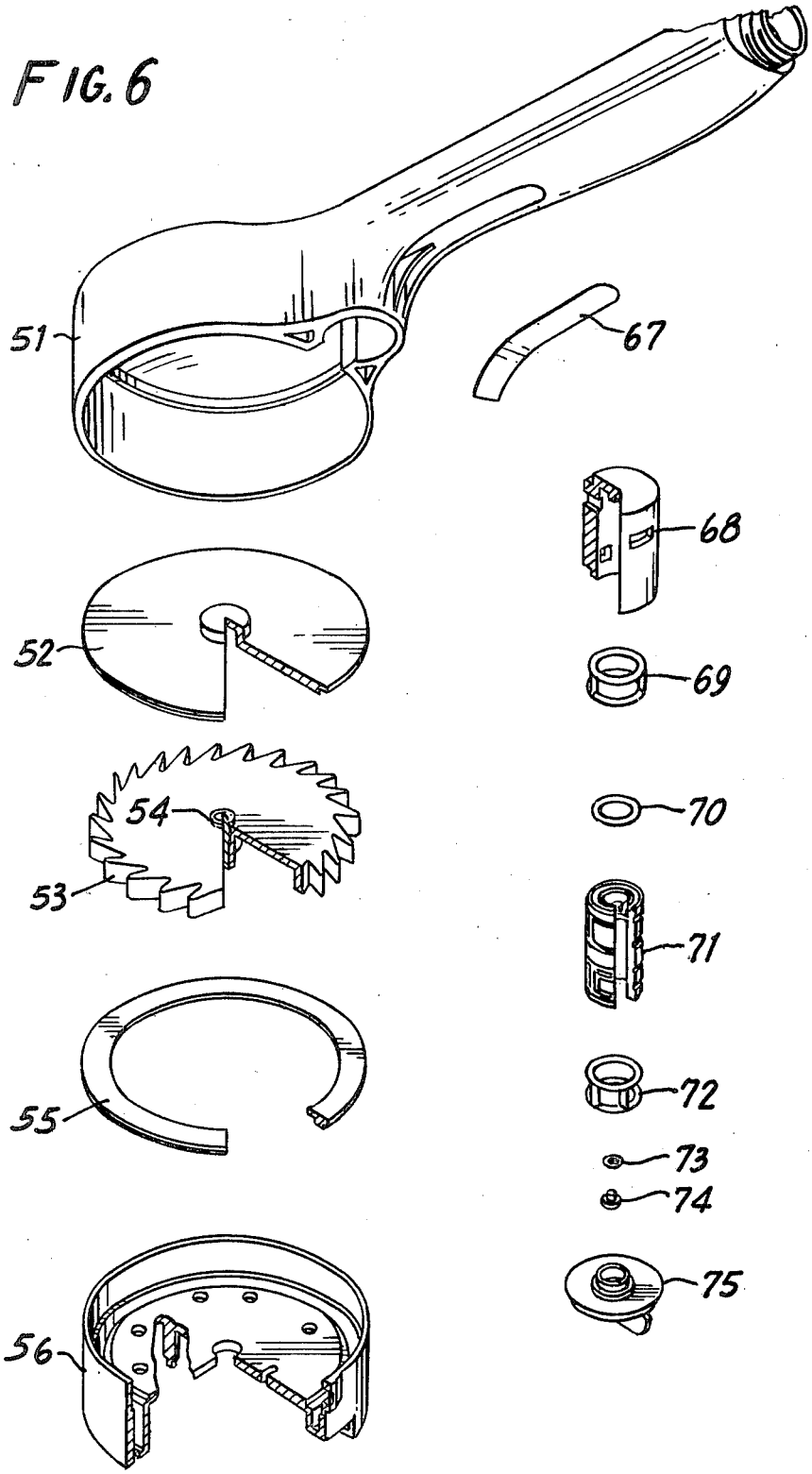
FIGS. 6 and 7 together constitute a diagrammatic exploded view of a second shower head according to an embodiment of the invention.
Figure 7:
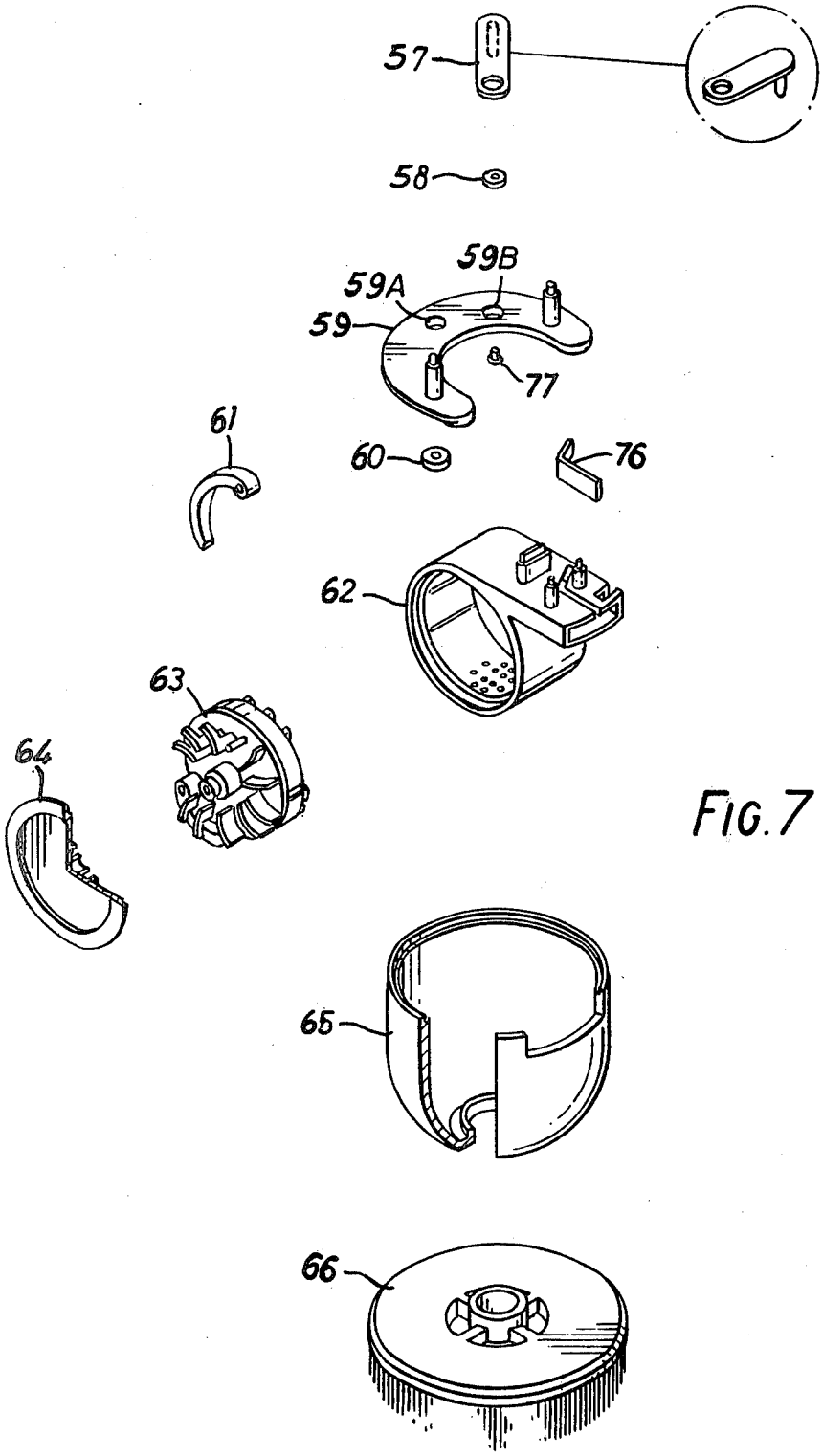
Figure 8:
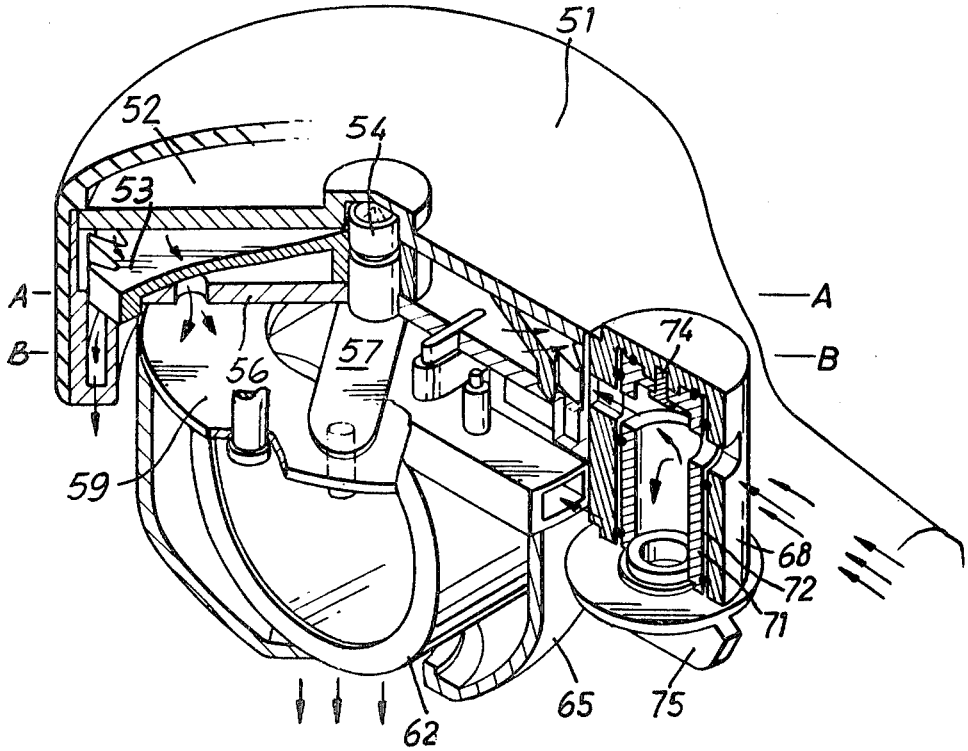
FIG. 8 shows a cutaway perspective view showing the embodiment of FIGS. 6 and 7 partly in section through the axis of rotation of the turbine member thereof.

FIGS. 6-7 of the drawings show an exploded view of a shower spray head according to a further embodiment of the invention.

The spray head comprises a combined handle and upper housing portion 51, and an inner housing of which a top cover is shown at 52. Mounted for rotation within the inner housing is a nylon toothed flywheel 53 secured to a rotatably mounted eccentrically-projecting brass camshaft 54. Disposed below flywheel 53 is a divider ring 55 forming a lower peripherally perforated spray forming chamber within the remainder of the inner housing 56. The eccentrically-projecting camshaft 54 extends through a hole in a spigoted lever arm 57 of which the spigot is pivotally secured via a washer 58 in a hole 59B in a vibratory member 59 of crescent shape.

Vibratory member 59 has a further hole 59A by which it is rotatably secured to a spigot X of inner housing 56 by a nut or washer 60. Also secured to inner housing 56 is a rotary valve arrangement contained in an apertured casing 62 for supplying a pulsating shower stream: such a valve including an arcuate flap as shown here at 61, a valve chamber body 62, a turbine-bearing rotary valve member 63 and a valve chamber closure 64 is fully described in U.K. Patent Specification No. 1,490,836, which corresponds to my U.S. patent application No. 761,325, now U.S. Pat. No. 4,079,891, the disclosure of which is incorporated herein by reference.

Disposed about the rotary valve arrangement and chamber 62 is a vibratory head 65 having a lower aperture for emergence of a pulsating spray from outlets in chamber 62, and fitted by a screw thread about said aperture is a brush-bearing plate 66. Vibratory head 65 is open above and is secured to crescent-shaped vibratory member 59 at its edge.

The spray-head also incorporates a labelling strip 67 secured to housing and handle member 51, and a bush insert 68, rubber seal 69, rubber ring 70, valve member 71, and associated rubber seal 72, washer 73, screw 74 and knob 75 together located in and projecting from a recess in handle and housing member 51 to form a user-operable valve switch to direct a water inflow from the handle to any of three outlets into the housing and structures therein, in known manner and as described with reference to FIGS. 1-5.

Figure 11:
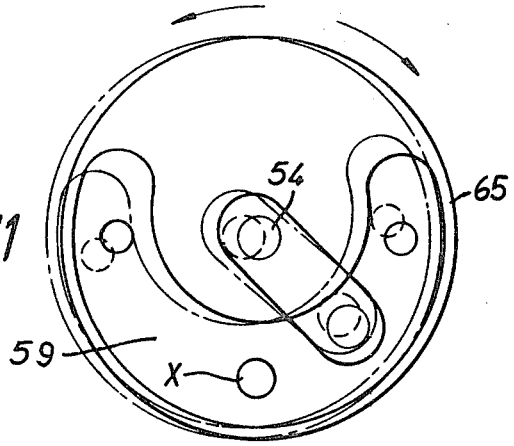
FIG. 11 is a fragmentary plan view of the vibratory member and spigoted level arm of the embodiment of FIGS. 6–10, showing the direction and extent of their vibratory motion during use.
Figure 9:
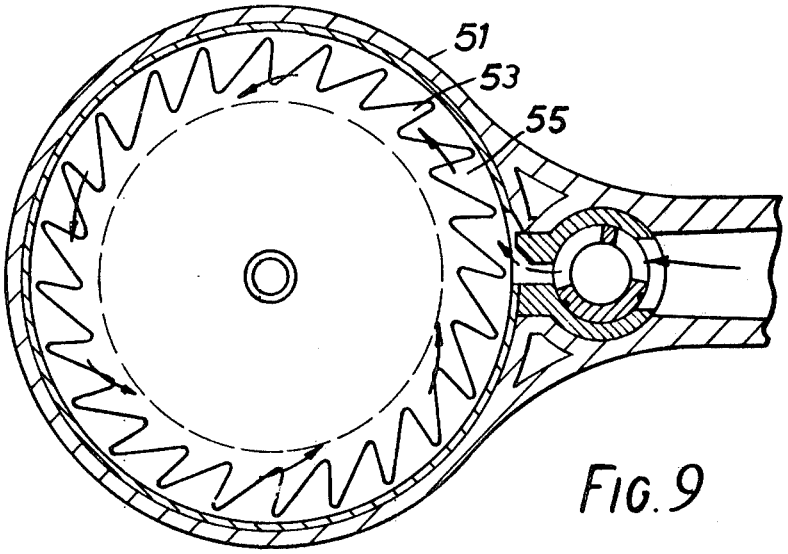
FIG. 9 is a fragmentary part-sectional plan view at the level A—A in FIG. 8, transverse to said axis, to show one fluid flow path.
Figure 10:
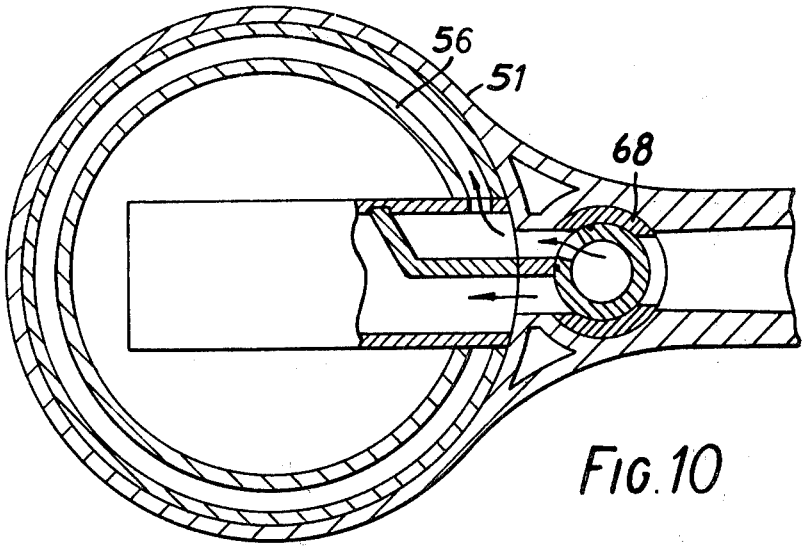
FIG. 10 is a fragmentary part-sectional view at the level B—B in FIG. 8, transverse to said axis, to show further fluid flow paths.

In use, water enters through the handle of handle and housing member 51 via the members 68-75 forming the switch, and is directed into any of three courses as shown in FIGS. 9 to 11. In one such course, the water is directed into the inner housing 56 into the upper part thereof above the divider ring 55, wherein is located the flywheel 53. The direction of water flow is such as to drive flywheel 53 in rotation, so causing rotation of the eccentrically-projecting camshaft 54 and hence reciprocating motion of spigoted lever arm 57. Such reciprocating motion causes oscillation of vibratory member 59 and the head 65 and brush 66 attached thereto, with relatively small amplitude about the pivotal mounting 59A of vibratory member 59, as shown more clearly in FIG. 11.

The water flow which causes the vibration emerges as a shower spray around vibrating head 65 through apertures in the floor of the upper portion of inner housing 56.

A second course for water flow, controllable by the switch (members 68-75) channels water flow into rotary valve chamber 62 to produce a pulsating shower spray.

A third course for water flow, controllable by the switch (members 68-75) channels water flow into the lower-peripherally perforated spray-forming chamber within the lower remainder of inner housing 56. This water flow emerges as a steady shower spray from the lower periphery of inner housing 56.

Thus it can be seen that this embodiment of the invention includes facility for providing a steady shower-spray, and/or pulsating shower-spray, and/or shower-spray with vibration of a brush-bearing portion of the shower spray head.

I claim:

1. A shower spray head for providing a fluid spray with mechanical vibration of a part of said head; said shower spray head comprising, in combination, means forming a path for fluid flow and for delivering a shower spray; a turbine member mounted in said path and drivable in rotation about an axis by fluid flow through said path; an eccentric member mounted for rotation about said axis and which is drivable by said turbine member and is eccentrically mounted with respect to said axis; and a vibratory member connected by a pivotal connexion to said eccentric member whereby rotation of said turbine member during use causes vibration of said vibratory member in one plane substantially at right angles to the turbine member axis of rotation and causes consequent vibration of said part of said head in said one plane.

2. A shower spray head according to claim 1, wherein said eccentric member is in the form of an eccentric cam and said vibratory member has an aperture therein with said aperture pivotally located about said cam with play.

3. A shower spray head according to claim 2, wherein said cam is an elliptical formation integral with said turbine member and disposed eccentrically about said axis, and said aperture in said vibratory member is a circular aperture located with play about said formation.

4. A shower spray head according to claim 1, wherein said eccentric member is in the form of an eccentric cam and said vibratory member is pivotally connected to said cam by an arm having one end pivotally connected to said cam, and the other end of said arm being connected to said vibratory member, said vibratory member being mounted for reciprocating motion about an axis which is spaced from said axis of rotation of said turbine member.

5. A shower spray head according to claim 1, wherein said vibratory member comprises a portion of a housing of said shower spray head.

6. A shower spray head according to claim 1, having means forming two alternative flow paths, a first alternative flow path including pulsation means for cyclic interruption of the fluid flow along it, for providing a pulsating spray, and a second alternative flow path for producing a non-pulsating spray, and control means manually operable to distribute the flow adjustably amongst the flow paths.

7. A shower spray head according to claim 1, wherein a massage brush is mounted on said vibratory member.

* * * * *